US005408240A

United States Patent [19]

Battista et al.

[11] Patent Number: 5,408,240

[45] Date of Patent: Apr. 18, 1995

[54] SUSPENDED STRIPLINE RF FEED WITH ORTHOGONAL COAXIAL TRANSITIONS AND PLASTIC HOUSING

[75] Inventors: Daniel M. Battista, Marina Del Rey; Clifton Quan, Arcadia; Gary L. Crandall, Los Angeles, all of Calif.

[73] Assignee: Hughes Aircraft Company, Los Angeles, Calif.

[21] Appl. No.: 174,945

[22] Filed: Dec. 23, 1993

[51] Int. Cl.[6] ..... H01Q 23/00

[52] U.S. Cl. ..... 342/368; 343/853; 333/245; 361/707

[58] Field of Search ..... 342/368; 333/245, 246; 361/703, 707, 729, 749, 814; 343/853

[56] References Cited

U.S. PATENT DOCUMENTS 5,099,254 3/1992 Tsukii et al. ..... 343/853
5,206,712 4/1993 Kornrumpf ..... 361/393
5,278,574 1/1994 Zimmerman et al. ..... 343/853 X
5,327,152 7/1994 Kruger et al. ..... 343/853
5,345,205 9/1994 Kornrumpf ..... 333/246

*Primary Examiner*—Mark Hellner
*Attorney, Agent, or Firm*—Leonard A. Alkov; W. K. Denson-Low

[57] ABSTRACT

A suspended stripline corporate feed with an orthogonal transition to a coaxial transmission line at each of its input/output ports. Alternate I/O ports are pointed in opposite directions so that devices on both sides of the feed can be serviced by the same circuit. The cover for the feed is made out of injection molded, copper plated plastic. When utilized to distribute RF energy to T/R modules in an Active Array, the feed is machined as an integral part of the heat exchanger which cools the modules.

30 Claims, 4 Drawing Sheets

SUSPENDED STRIPLINE RF FEED WITH ORTHOGONAL COAXIAL TRANSITIONS AND PLASTIC HOUSING

BACKGROUND OF THE INVENTION

This invention relates to corporate feed networks for antenna systems.

Corporate feed networks are conventionally used to distribute power from transmit/receive (T/R) modules to array radiating elements.

Vertical distribution of RF signals in active arrays is presently accomplished by means of suspended stripline feeds with in-line coaxial interconnects. Two feeds are required for every column of T/R modules, one for the upper half of the column and one for the lower half. A typical array might require a total of 120 feeds, which make up a significant portion of the total array cost.

The feed housings are made entirely from machined aluminum. They are fabricated and assembled separate from the heat exchangers and installed at a higher assembly level. This method is heavy and consumes a considerable amount of space.

An object of this invention is to provide a feed network which can be smaller, lighter and less expensive to fabricate than conventional feed networks.

SUMMARY OF THE INVENTION

In accordance with the invention, a suspended stripline corporate feed is described with an orthogonal transition to a matched coaxial transmission line at each of its input/output ports. The suspended stripline can have circuit traces plated on one side or the other or both. Alternate input/output (I/O) ports are pointed in opposite directions, so that T/R modules on both sides of the feed can be serviced by the same circuit. This reduces by half the number of feeds required for a given array.

According to one aspect of the invention, half of the feed housing is machined as an integral part of the heat exchanger which cools the T/R modules. The other half is made from injection molded plastic, copper plated to make the surface electrically conductive. The plastic is loaded with glass fibers so that its thermal coefficient of expansion is matched to that of aluminum.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
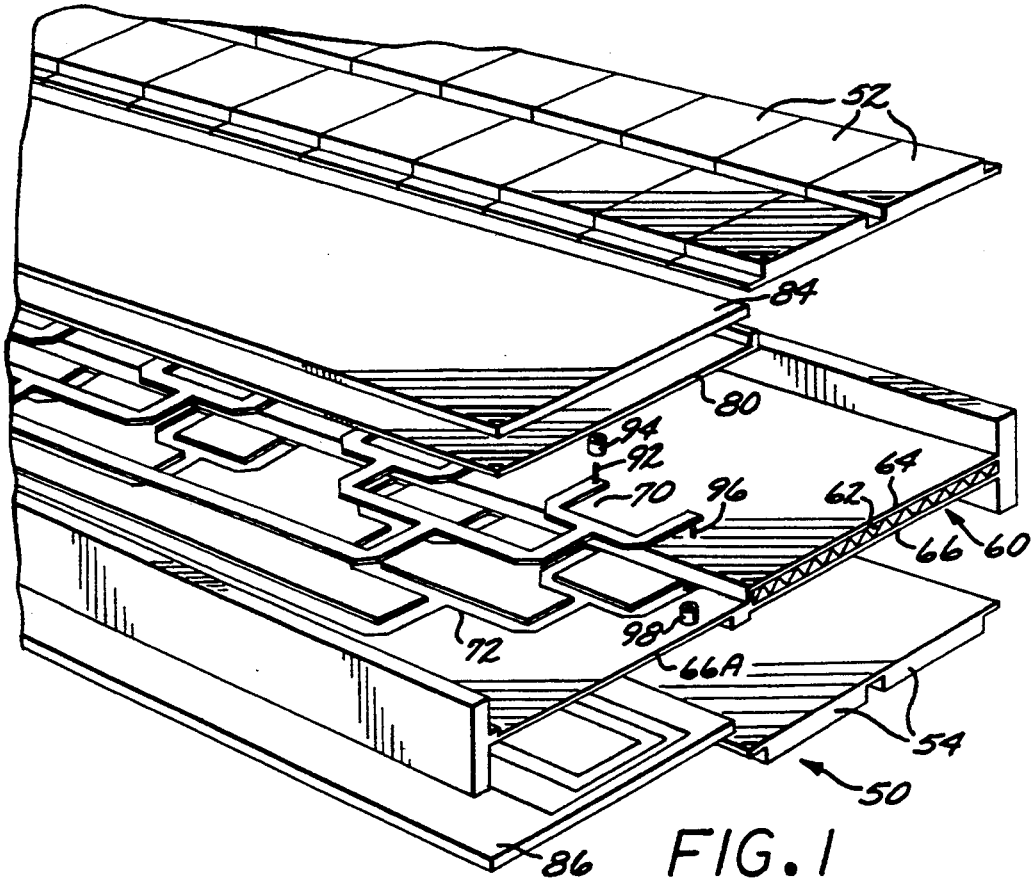
FIG. 1 is an exploded perspective view illustrative of a feed network embodying the invention.

FIG. 1 illustrates an active array system assembly 50 embodying the present invention. The array includes a plurality of transmit/receive (T/R) modules 52 and 54 disposed respectively on opposite sides of the assembly. The assembly further includes a heat exchanger 60, and the modules 52 and 54 sandwich the heat exchanger for cooling of the modules.

The heat exchanger 60 includes cooling fin stock 62 sandwiched by upper and lower metal plate surfaces 64 and 66, typically formed of aluminum. The lower surface 66 is extended to form aluminum surface 66A, which in turn provides a ground plane channel 72 for a suspended stripline transmission line corporate feed circuit 70 which matches the layout of the feed circuit layout. The other ground plane channel completing the transmission line circuit 70 is defined by a feed cover 80.

The cover 80 is fabricated, in accordance with the invention, of injection molded plastic, and copper plated to make the surface electrically conductive. It is desired that the plastic material have a thermal coefficient of expansion matched to that of aluminum. A plastic such as polyetherimide or that marketed under the trade name ULTEM, both of which are marketed by General Electric Company, loaded with 30% by weight of glass fibers, has been found suitable for the purpose. The cover 80 has a relieved channel pattern formed therein which is the mirror image of the channel pattern formed in the surface 66A.

A pair of power and control signal distribution printed wiring boards (PWBs) 84 and 86 sandwich the aluminum surface member 62A, and the cover 80. The PWBs 84 and 86 carry dc power and control signals for the active elements comprising the assembly 50.

Alternate input/output ports for the transmission line 70 are pointed in opposite directions so that the modules on either side of the heat exchanger can be serviced by the feed comprising the transmission line 70. This is depicted generally in FIG. 1 by coaxial pin launchers 92 and 96, pointing in opposite directions, and the dielectric concentric spacer elements 94 and 98.

Figure 2:
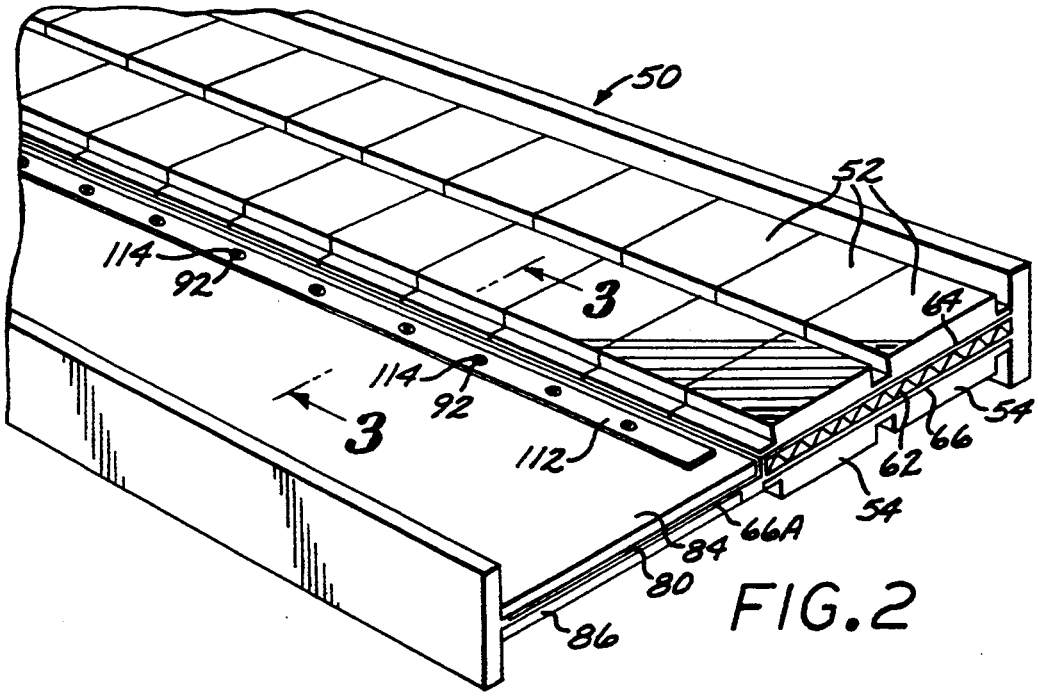
FIG. 2 shows the feed network of FIG. 1 in assembled form.

FIG. 2 shows the active array system assembly 50 in a assembled configuration.

Figure 3:
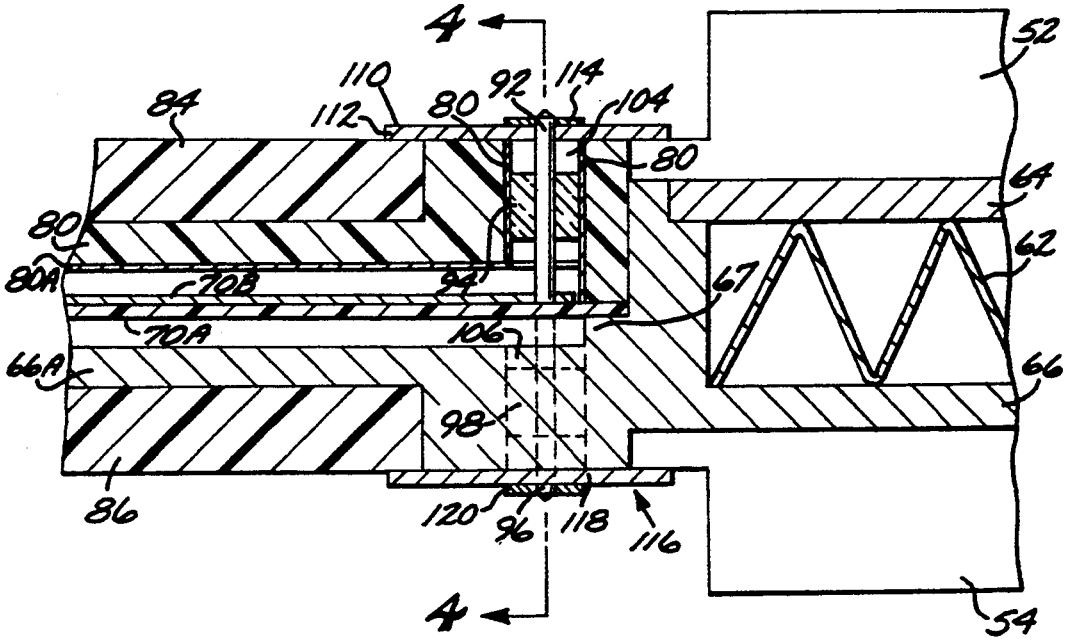
FIG. 3 is a cross-sectional view taken along line 3—3 of FIG. 2.
Figure 4:
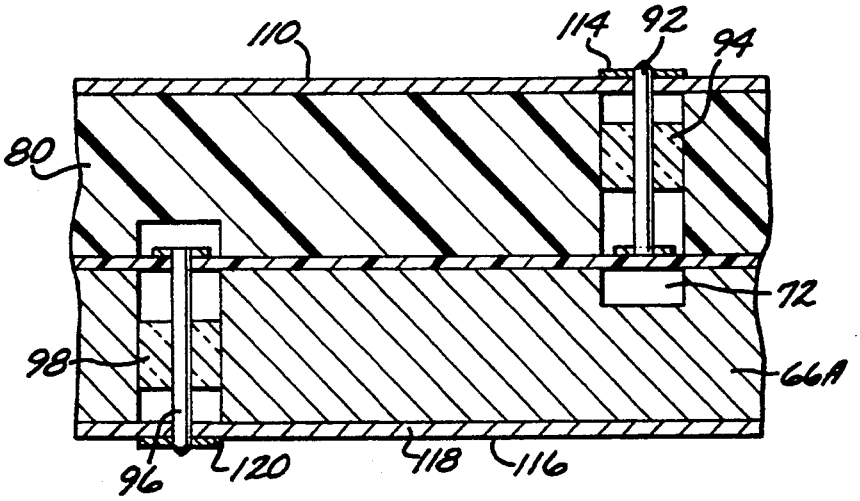
FIG. 4 is a cross-sectional view taken along line 4—4 of FIG. 3.

FIG. 3 is a cross-sectional view taken along line 3—3 of FIG. 2. FIG. 4 is a cross-sectional view taken along line 4—4 of FIG. 3. FIGS. 3 and 4 illustrate in further detail the relationship of the transmission line circuit and the coaxial pin launchers. An end of the dielectric stripline substrate board 70A is supported by a shoulder 67 of the heat exchanger plate 66A, so that the board 70A is suspended between the plate 66A and cover plate 80. As shown in FIG. 3, cover 80 is plated with a copper coating 80A. A conductive line 70B is defined on the upper surface of the substrate board 70A, thereby defining a suspended substrate stripline transmission line. The line 70B makes electrical contact with the conductive coaxial pin launcher 92 extending upwardly through a circular opening formed 104 in the cover 80. The dielectric spacer 94 supports the pin 92 within the opening 104.

An RF/DC flexible interconnect circuit 110 includes a flexible dielectric substrate 112, on which is defined an RF conductive trace 114. The conductive trace 114 contacts the pin launcher 92 to electrically connect to the coaxial line, thereby coupling the suspended stripline circuit 70 to the interconnect circuit 110. The trace 114 in turn leads to a connection (not shown) with circuitry comprising the T/R module 52.

The suspended stripline circuit 70 is also electrically coupled to the T/R module 54 located on the opposite side of the heat exchanger 60 from the module 52. This is done via the coaxial feedthrough comprising coaxial pin launcher 96 and dielectric spacer 98 fitted within circular opening 106 (shown in phantom) in the plate 66A. This coaxial feedthrough extends orthogonally to the suspended stripline circuit, but in the opposite direction from the coaxial feedthrough comprising pin launcher 92, thus allowing the suspended stripline feed network 70 to service T/R modules located on both sides of the heat exchanger. The pin launcher 96 makes electrical contact with the conductive trace 120 comprising flexible interconnect circuit 116, which also includes a flexible dielectric substrate 118. The conductive trace 120 in turn leads to a connection (not shown) with circuitry comprising the T/R module 54.

Figure 5:
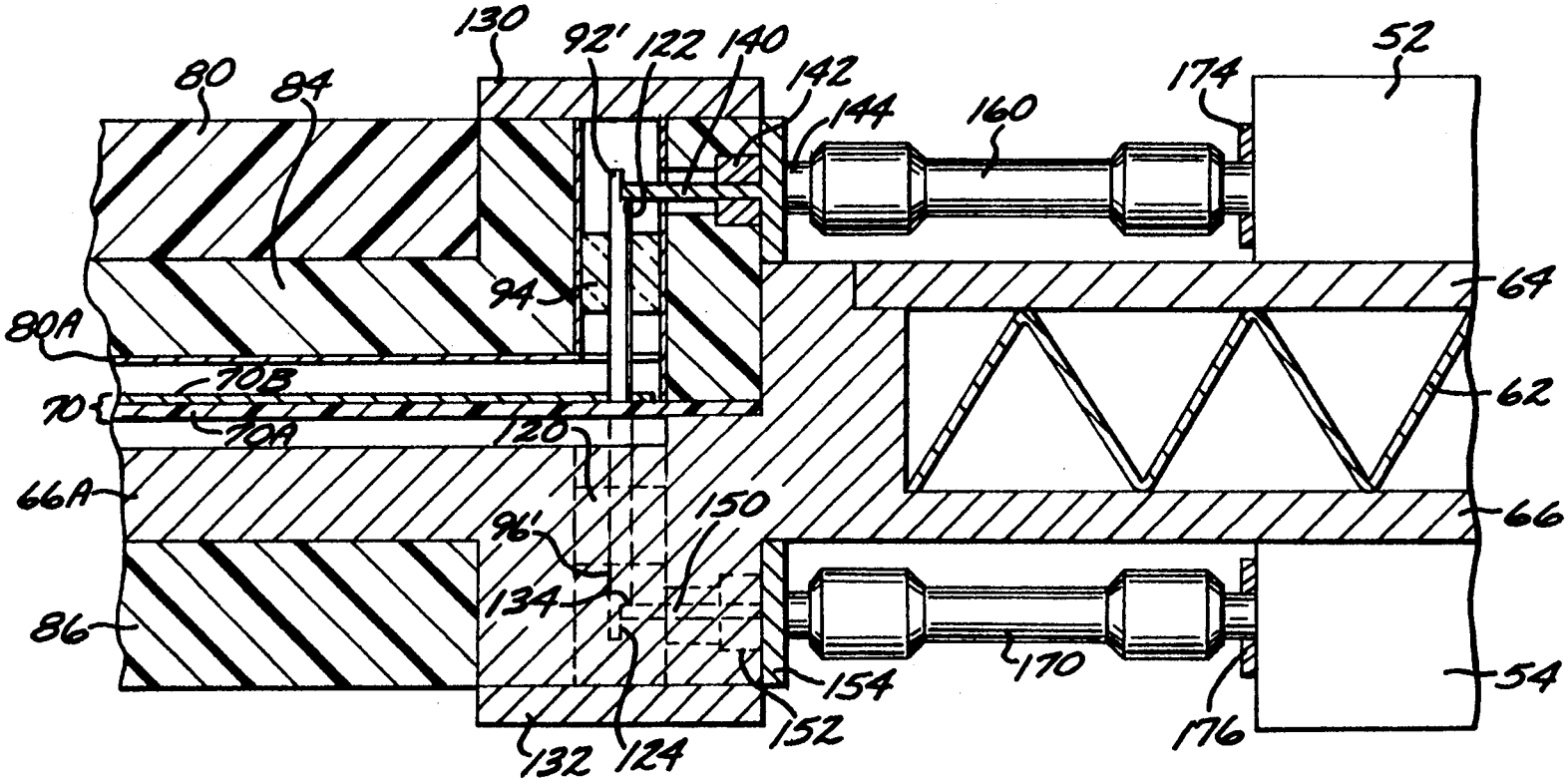
FIG. 5 is a cross-sectional view illustrative of an alternate interconnection technique.

FIG. 5 shows an alternative embodiment of the manner for connecting the T/R modules 52 and 54 to the suspended stripline feed circuit 70. In this embodiment, the orthogonal pin launchers are connected to orthogonally disposed coaxial feedthroughs, in turn connected through short coaxial cables to coaxial feedthroughs on the T/R modules. The pin launchers 92′ and 96′ have material removed at the ends thereof to form shoulders 122 and 134, respectively. Coaxial center conductor pins 140 and 150 of respective sub-subminiature assembly (SSMA) connectors extend through bores formed in the cover 80 and in the plate 66A, and are supported by dielectric plugs 142 and 152. The ends of the pins 140 and 150 intersect the respective ends of the pin launchers 92′ and 96′ and make electrical contact therewith. Connector fittings 144 and 154 complete the respective SSMA connectors. Coaxial cables 160 and 170 electrically interconnect between these SSMA connectors and corresponding connectors 174 and 176 of the T/R modules 52 and 54, thereby completing the connection between the suspended stripline feed circuit 70; and the T/R modules 52 and 54. Covers 130 and 132 seal the exposed ends of the coaxial transitions.

Figure 6:
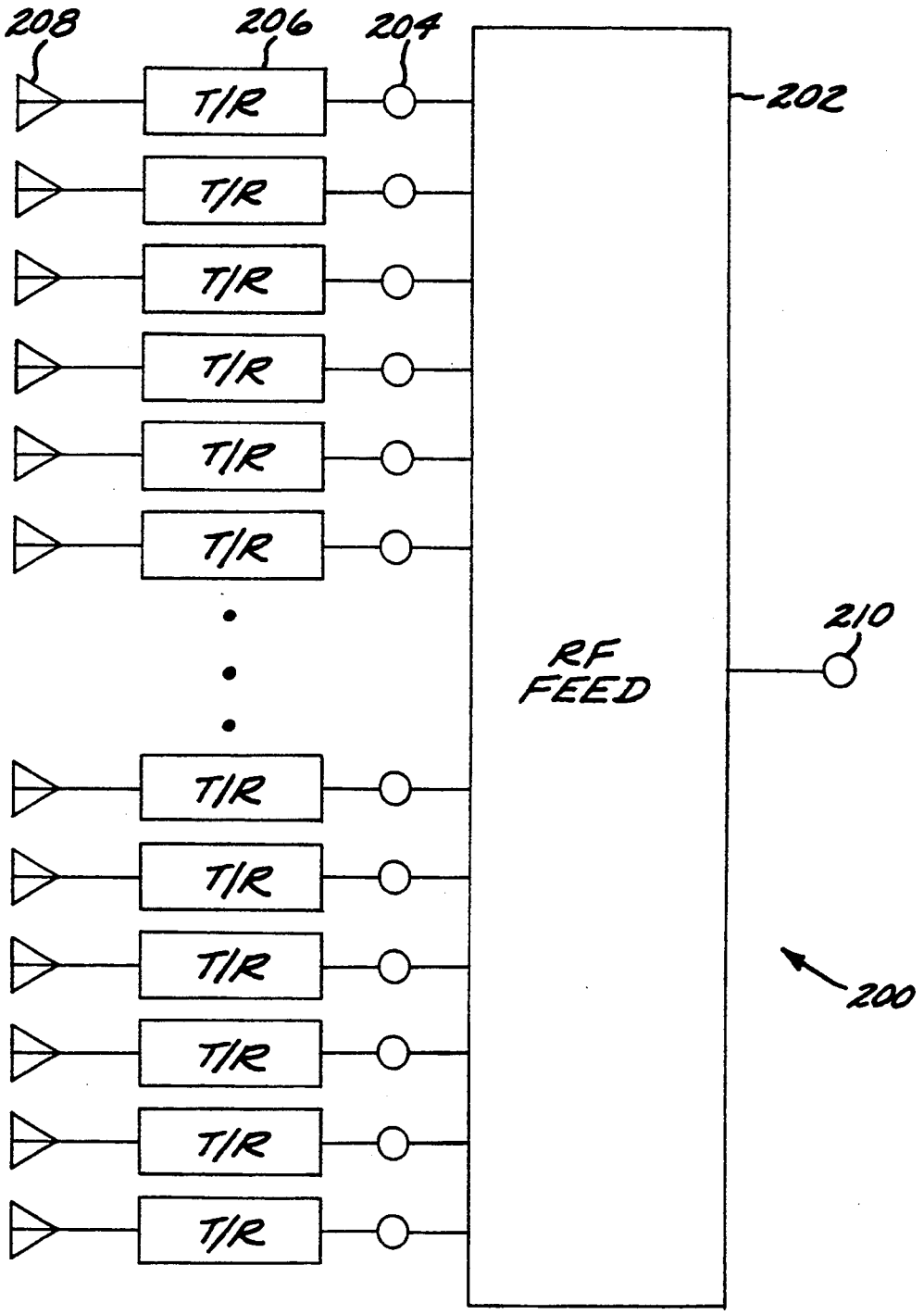
FIG. 6 is a simplified schematic of elements of an active array system embodying this invention.

FIG. 6 shows a simplified schematic diagram of components of an active array system 200 embodying the present invention. The system 200 includes a suspended stripline RF feed network 202 including a plated plastic housing as described above. Orthogonal coaxial transitions 204 connect the suspended stripline feed network 202 and the T/R modules 206, the T/R modules 206 are in turn connected to the array radiating elements 208. The feed network 202 further includes an I/O port 210.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A suspended stripline RF feed network with one or more coaxial transitions to service input/output ports extending orthogonally to said stripline network, comprising:

a stripline dielectric substrate having first and second opposed surfaces, said substrate having defined on said first surface a stripline conductor pattern defining a desired stripline feed configuration;

a first groundplane defining structure disposed adjacent said first surface and defining a first relieved channel pattern in correspondence with said conductor pattern, said first groundplane defining structure comprises a plastic structure which has been plated with a layer of conductive material to define a first groundplane;

a second groundplane defining structure disposed adjacent said second surface and defining a second relieved channel pattern in correspondence with said conductor pattern;

said first and second groundplane defining structures sandwiching said substrate; and a coaxial transition comprising a first coaxial launcher pin connected to said stripline conductor, said pin extending away from said first surface of said substrate in a direction generally orthogonal to said surface.

2. The network of claim 1 wherein said RF stripline circuit defines a corporate feed network.

3. An active array radar system assembly, comprising:

a plurality of transmit/receive (T/R) modules;

an RF feed assembly for servicing said T/R modules, comprising:

a suspended stripline substrate having a stripline conductor line pattern formed thereon;

a plurality of orthogonal transitions connected to said stripline conductor line to service input/output ports, wherein said transitions extend in a direction orthogonal to said substrate and are connected to respective ones of said first set of T/R modules; and a first groundplane and a second groundplane defined by a cover member, said first and second groundplanes sandwiching said suspended stripline substrate.

4. The assembly of claim 3 wherein said first groundplane member is fabricated of an electrically conductive material, and comprises a relieved channel pattern defined therein in correspondence with said stripline conductor line pattern.

5. The assembly of claim 3 wherein said cover member is fabricated of a plastic material, having an electrically conductive coating applied thereon.

6. The assembly of claim 5 wherein said second groundplane comprises a relieved channel pattern defined therein in correspondence with said stripline conductor line pattern.

7. The assembly of claim 3 wherein said orthogonal coaxial transitions each comprise a coaxial launcher pin connected to said stripline conductor line.

8. The assembly of claim 7 further comprising means for electrically connecting said coaxial transitions to respective ones of said T/R modules.

9. The assembly of claim 8 wherein said electrically connecting means comprises a flexible interconnect circuit disposed orthogonally to one of said pins, said circuit including a flexible dielectric substrate having a conductor pattern defined thereon, and wherein one of said pins is electrically connected to said conductor pattern on said flexible substrate.

10. The assembly of claim 8 wherein said electrically connecting means comprises coaxial connector means, said means including a center conductor pin extending parallel to said stripline substrate and in electrical contact with one of said pins.

11. A suspended stripline RF feed network with a plurality of orthogonal coaxial transitions to service input/output ports extending orthogonally to said stripline network, comprising:

a stripline dielectric substrate having first and second opposed surfaces, said substrate having defined on said first surface a stripline conductor pattern defining a desired stripline feed configuration;

a first groundplane defining structure disposed adjacent said first surface and defining a first relieved channel pattern in correspondence with said conductor pattern;

a second groundplane defining structure disposed adjacent said second surface and defining a second relieved channel pattern in correspondence with said conductor pattern;

said first and second groundplane defining structures sandwiching said substrate;

a first coaxial transition comprising a first coaxial launcher pin connected to said stripline conductor, said pin extending away from said first surface of said substrate in a direction generally orthogonal to said surface; and a second coaxial transition comprising a second coaxial launcher pin connected to said stripline conductor, said pin extending away from said second surface of said substrate in a direction generally orthogonal to said surface and opposite the direction of said first coaxial transition.

12. The network of claim 11 wherein said first groundplane defining structure comprises a plastic structure which has been plated with a layer of conductive material to form a first groundplane for said stripline transmission circuit.

13. The network of claim 11 wherein said RF stripline circuit defines a corporate feed network.

14. An active array radar system assembly, comprising:

a plurality of transmit/receive (T/R) modules;

means for positioning said T/R modules in a multilayered relationship, wherein a first set of said T/R modules is disposed in a first substantially planar layer, and a second set of said T/R modules is disposed in a second substantially planar layer;

an RF feed assembly for servicing both said first and second sets of modules, comprising:

a suspended stripline substrate having a stripline conductor line pattern formed thereon;

a plurality of orthogonal transitions connected to said stripline conductor line to service input/output ports, wherein a first set of said transitions extend in a first direction orthogonal to said substrate and are connected to respective ones of said first set of T/R modules, and a second set of said transitions extend in a second direction orthogonal to said substrate and opposite to said first direction and are connected to said second set of T/R modules; and a first groundplane and a second groundplane defined by a cover member, said first and second groundplanes sandwiching said suspended stripline substrate.

15. The assembly of claim 14 wherein said first groundplane member is fabricated of an electrically conductive material, and comprises a relieved channel pattern defined therein in correspondence with said stripline conductor line pattern.

16. The assembly of claim 14 wherein said cover member is fabricated of a plastic material, having an electrically conductive coating applied thereon.

17. The assembly of claim 16 wherein said second groundplane comprises a relieved channel pattern defined therein in correspondence with said stripline conductor line pattern.

18. The assembly of claim 14 wherein said orthogonal coaxial transitions each comprise a coaxial launcher pin connected to said stripline conductor line.

19. The assembly of claim 18 further comprising means for electrically connecting said coaxial transitions to respective ones of said T/R modules.

20. The assembly of claim 19 wherein said electrically connecting means comprises a flexible interconnect circuit disposed orthogonally to one of said pins, said circuit including a flexible dielectric substrate having a conductor pattern defined thereon, and wherein one of said pins is electrically connected to said conductor pattern on said flexible substrate.

21. The assembly of claim 19 wherein said electrically connecting means comprises coaxial connector means, said means including a center conductor pin extending parallel to said stripline substrate and in electrical contact with one of said pins.

22. An active array radar system assembly, comprising:

a plurality of transmit/receive (T/R) modules;

a heat exchanger, comprising first and second plates sandwiching a cooling element, and wherein a first one of said T/R modules is disposed adjacent an exposed surface of said first plate, and a second one of said T/R modules is disposed adjacent an exposed surface of said second plate, said second plate further comprising an extension plate member;

an RF feed assembly for servicing both said first and second modules, comprising a suspended stripline substrate having a stripline conductor line pattern formed thereon, a plurality of orthogonal transitions connected to said stripline conductor line to service input/output ports in turn connected to respective ones of said T/R modules, a first groundplane defined by said extension plate member, a second groundplane defined by a cover member, said first and second groundplanes sandwiching said suspended stripline substrate.

23. The assembly of claim 22 wherein said extension plate member is fabricated of an electrically conductive material, and comprises a relieved channel pattern defined therein in correspondence with said stripline conductor line pattern.

24. The assembly of claim 22 wherein said cover member is fabricated of a plastic material, having an electrically conductive coating applied thereon.

25. The assembly of claim 24 wherein said second groundplane comprises a relieved channel pattern defined therein in correspondence with said stripline conductor line pattern.

26. The assembly of claim 22 wherein said orthogonal coaxial transitions each comprise a coaxial launcher pin connected to said stripline conductor line.

27. The assembly of claim 26 further comprising means for electrically connecting said coaxial transitions to respective ones of said T/R modules.

28. The assembly of claim 27 wherein said electrically connecting means comprises a flexible interconnect circuit disposed orthogonally to one of said pins, said circuit including a flexible dielectric substrate having a conductor pattern defined thereon, and wherein one of said pins is electrically connected to said conductor pattern on said flexible substrate.

29. The assembly of claim 27 wherein said electrically connecting means comprises coaxial connector means, said means including a center conductor pin extending parallel to said stripline substrate and in electrical contact with one of said pins.

30. The assembly of claim 22 further comprising first and second wiring boards for distributing dc power/-control signals to said T/R modules, said first and second boards sandwiching said RF feed assembly.

* * * * *